US008356556B2

(12) United States Patent
Piasecki et al.

(10) Patent No.: US 8,356,556 B2
(45) Date of Patent: Jan. 22, 2013

(54) UNIVERSAL DOG CHAIN

(75) Inventors: David Piasecki, Norwalk, OH (US); Satoru Kuyama, Sandusky, OH (US); Amanda Holbrook, Sandusky, OH (US)

(73) Assignee: U.S. Tsubaki, Inc., Wheeling, IL (US)

( * ) Notice: Subject to any disclaimer, the term of this patent is extended or adjusted under 35 U.S.C. 154(b) by 273 days.

(21) Appl. No.: 12/657,688

(22) Filed: Jan. 26, 2010

(65) Prior Publication Data

US 2011/0179968 A1 Jul. 28, 2011

(51) Int. Cl.
*B61B 12/00* (2006.01)

(52) U.S. Cl. ..... 104/172.5; 104/172.1

(58) Field of Classification Search ..... 104/172.1, 104/172.2, 172.3, 172.4; 198/731, 687, 851; 59/93, 78, 84, 85
See application file for complete search history.

(56) References Cited

U.S. PATENT DOCUMENTS 1,748,334 A * 2/1930 Evans ..... 198/731

* cited by examiner

*Primary Examiner* — Mark Le
(74) *Attorney, Agent, or Firm* — James Creighton Wray

(57) ABSTRACT

Drive dog chains are assembled with alternating universal inside attachment links and outside sidebars and riveted pin connections. The universal inside attachment links have full size end sections and central sections of reduced height. Filler attachments are attached with machine screws to the central sections. Upper surfaces of the filler attachments are level with upper surfaces of the end sections and upper surfaces of the outside sidebars. Filler attachments are removed from selected ones of the center sections and replaced with pusher attachments secured at an end of each selected center section. A drive dog chain is manufactured and stored in uniform strands. Upon ordering, the pusher attachments replace the filler attachments at selected spacings on the chain.

15 Claims, 4 Drawing Sheets

UNIVERSAL DOG CHAIN

SUMMARY OF THE INVENTION

One version of an in-floor conveying system uses carts that are driven by a chain. Each cart has a floating pin that allows that the cart to engage a drive lug or drive dog of a chain. The chain is constructed in such a way to only drive the cart when the floating pin is engaged in the drive dog of the chain. The drive dog is different from all other links of the chain in that it allows for the pin to be captured and driven. The normal method of manufacturing the chain is to hard rivet all components together for durability. The position of the drive dog is determined at the time of chain manufacture and cannot easily be changed in the field.

Constructing such a chain requires an understanding of the attachment spacing before the building of the chain. Each chain is unique on the basis of the attachment spacing and the number of links in a strand of the chain. That is called the configuration of the chain. The configuration can vary from one attachment every other link to one attachment every 50 links. That uniqueness limits the application of a single configuration of chain and therefore limits the ability to build stock chains with certainty of selling the product.

The new Universal Dog Chain allows a chain to be built without hard integrated attachment features, which are drive dogs, that limit the number of systems with which the chain is usable. The invention eliminates the necessity to build fixed configurations into the chains by removing the uniqueness of the attachment links. The drawings identify the first, second and third components of the invention. The invention requires that the chain is built using new universal inside block links with fillers, firmly attached in all inside link positions. This effectively creates a chain with no drive dogs. The length of the built strand of the chain can be any amount that allows for easy handling at the time of assembly of the chain. Upon installation of the chain, at desired intervals, one component, the filler, is removed and is replaced with another component, the pusher attachment, at the spacing where a drive dog is desired. The different sub constructions are shown in the attached drawings.

The first components, universal inside blocks with centers having reduced heights, can be made as machined stampings or forgings. The second and third interchangeable components, the fillers and the pusher attachments, can be made as machined forgings or castings or can be machined from solid stock. The fasteners for connecting the second and third interchangeable components to the first component are machine screws, for convenience, but can be any semi-permanent attachment method, including welding or riveting.

The commercial value of the invention is the expanded utility of a stock chain, the reduction of different chain configurations in inventories, and the rapid filling of orders for specific cart drive dog chain configurations. This invention allows a single configuration of chain top be assembled and held for later purchase. The unique configuration can be made at the time of installation. The invention allows the viability of a universal stocking program to eliminate the lead-time associated with manufacturing to a specific configuration.

These and further and other objects and features of the invention are apparent in the disclosure, which include the above and ongoing written specification, with the claims and the drawings.

DETAILED DESCRIPTION OF THE DRAWINGS

Figure 1:
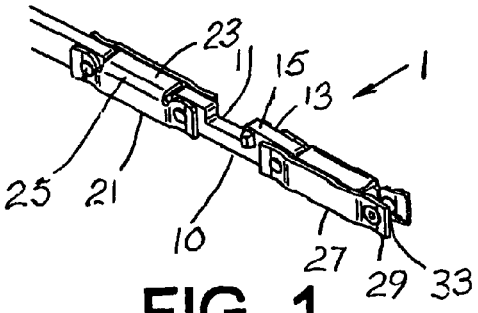
FIG. 1 is a perspective view of a prior art drive dog chain with pusher bars.
Figure 2:
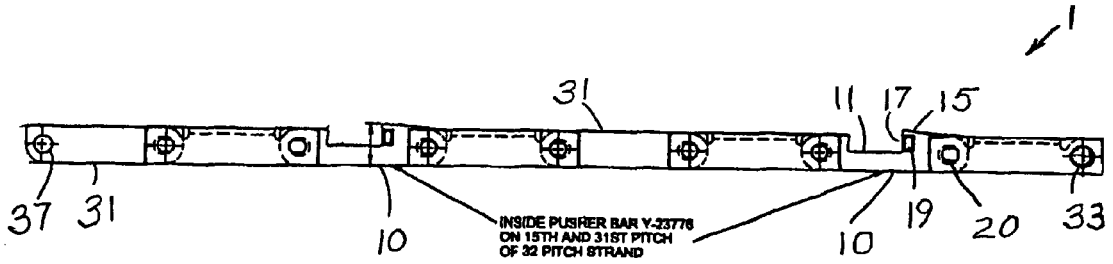
FIG. 2 is a side elevation of the prior art drive dog chain shown in FIG. 1.
Figure 3:
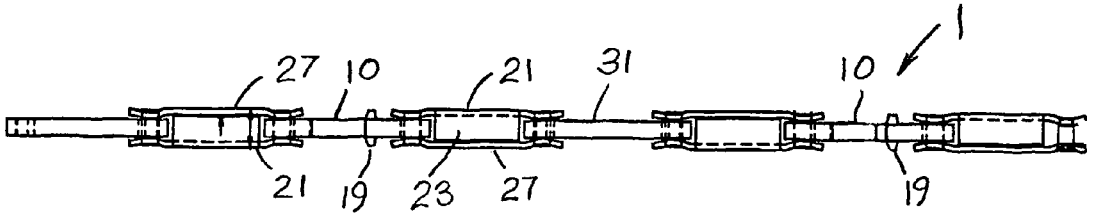
FIG. 3 is a top plan of the prior art drive dog chain shown in FIGS. 1 and 2.

FIGS. 1, 2 and 3 are perspective, side and top views of a prior art drive lug chain 1. The main inside pusher bar links 10 have a middle portion 11 with a reduced height and a raised end 13 with a sloping top 15, a pusher shoulder 17 and laterally extending lugs 19.

The pusher bar links 10 are connected by rivet pins 20 to outside sidebars 21 having tops 23 integrally connected at radii 25, and to opposite outside sidebars 27. The outside sidebars 21 and 27 have laterally outwardly bent ends 29 to allow the chain to turn around a horizontal radius of five feet or more.

Inside spacer blocks 31 are generally rectangular elongated blocks, which are connected to the outside sidebars 21, 27 in chain 1 by the rivet pins 20. The inside spacer blocks 31 are used to control the spaces between the inside pusher bars 10. At ends of the chain a shoulder screw 33 is mounted in ends of outside sidebars to extend through an end opening 37 in a spacer block 31 or pusher bar 10 at the end of the next adjacent strand. The invention eliminates the spacer bars 31 and replaces them and the pusher bar links with new universal inside links.

The length of chain shown in FIGS. 2 and 3 has an inside pusher bar 10 on $15^{th}$ and $31^{st}$ pitches of a 32 pitch strand.

The difficulty in the prior art is that each chain must be preassembled to generally desired pusher bar spacings, result in large inventories of different to meet chain users needs in a timely manner. Alternatively, after receiving orders for specific drive dog chain configurations, chain outside sidebars 21, 27, inside pusher bar links 10, inside spacer blocks 31 may be assembled with rivet pins 20 according to order. However, that delays delivery to customers of their required chains.

The present invention allows a uniform chain to be assembled and inventoried. Completion of the desired chain may be made quickly from a universal inventory in response to specific configuration orders by customers.

Figure 4:
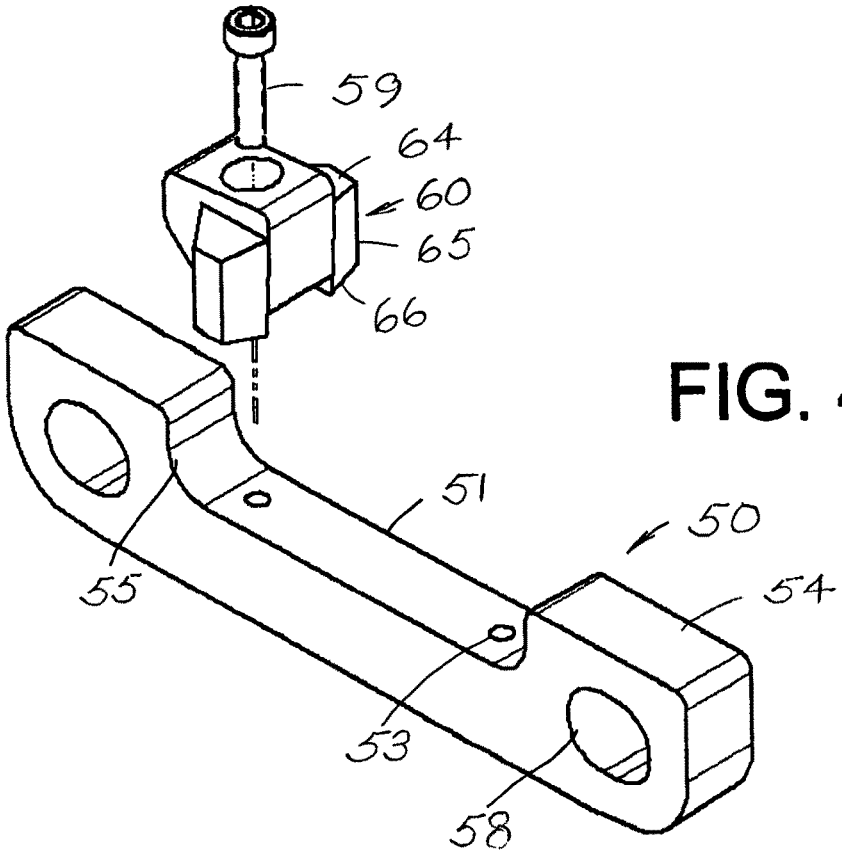
FIG. 4 is a perspective exploded view of a new drive dog chain link with a new pusher attachment.

FIG. 4 shows a perspective exploded view of a new drive dog chain universal inside block link 50 with a new pusher attachment 60. The new inside block link 50 has an overall generally rectangular shape with an elongated central portion 51 having a lowered height. Two vertical holes 53 are bored and tapped near symmetrical ends 55 of the central portion 51. As shown in FIG. 4, a machine screw 59 attaches a pusher to the central attachment portion 51 of the universal inside link 50. The pusher attachment 60 is mounted at one end of the central portion 51 of the new inside block link 50.

Figure 5:
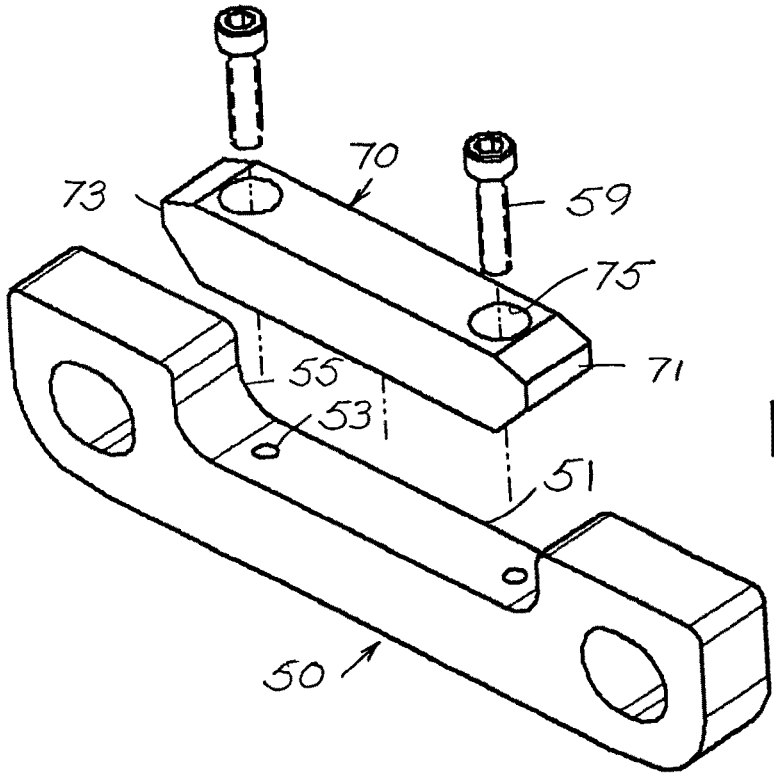
FIG. 5 is a perspective exploded view of the new drive dog chain link with a new filler bar.
Figure 6:
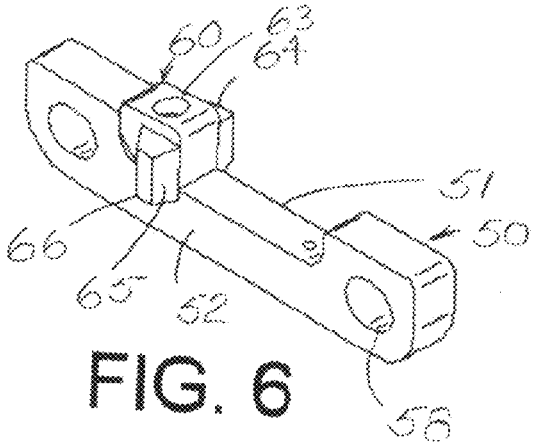
FIG. 6 is a perspective view of the drive dog chain link with the new pusher attachment as shown in FIG. 4.
Figure 9:
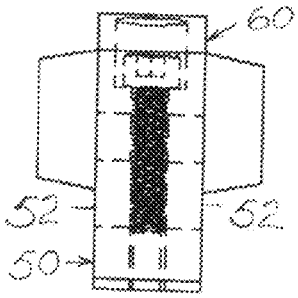
FIG. 9 is an end view of the new drive dog chain link with the new pusher attachment as shown in FIGS. 4, 6, 7 and 8.
Figure 7:
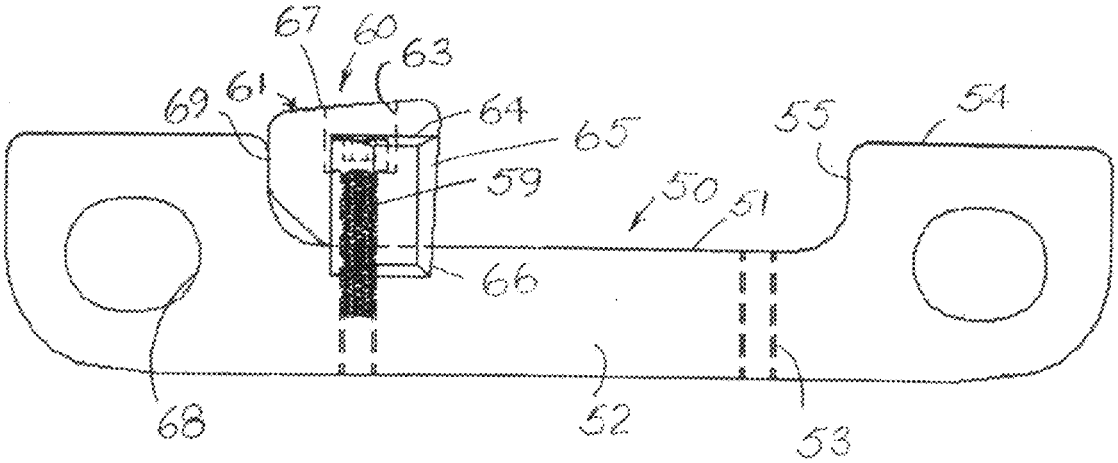
FIG. 7 is a side elevation of the new drive dog chain link with the new pusher attachment as shown in FIGS. 4 and 6.
Figure 8:
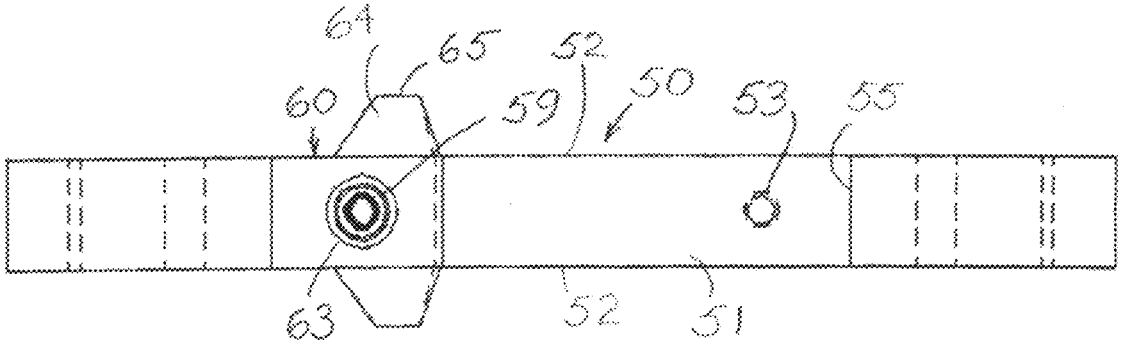
FIG. 8 is a top plan view of the new drive dog chain link with the new pusher attachment as shown in FIGS. 4, 6 and 7.

FIG. 5 is a perspective exploded view of a new universal drive chain link 50 with a filler bar 70. The filler bar has symmetrical opposite ends 71, 73 with countersunk holes 75 to receive machine screws 59 to fit and hold the filler bar 70 in the central portion 51 of the new inside block 50. A universal drive dog chain may be permanently assembled with rivet pins 20 connecting new universal inside blocks 50 and outside sidebars 21, 27. When a customer places an order, filler bars 70 and pusher attachments 60 are added in appropriate central portions 51 of universal inside links 50. Alternatively the chain is inventoried with fillers 70 in universal links 50. The fillers are removed and replaced with pusher attachments 60 where required.

FIGS. 6-9 show views of the assembled new universal block 50 and the pusher attachment 60. The pusher attachment has a generally cubical body 61 with a countersunk hole 63 for receiving a machine screw 59. Laterally extending lugs 65 have upper surfaces 64 level with the upper surfaces 54 of the new universal inside block 50. Lugs 65 have lower portions 66 that extend downward below the cubical body 61 for engaging opposite sides 52 of the universal inside block 50 and laterally stabilizing the pusher attachment 60. A top 67 of the pusher attachment is sloped and extends upward beyond the upper surfaces 54 of the universal inside block links 50, fillers 70 and outside sidebars 21, 27.

The back 69 of the pusher attachment 60 is sloped near the bottom to ensure a tight fit with an end 55 of the universal inside block link 50 when the machine screw 59 is tight.

The horizontal pin receiving holes 58 are elongated in a longitudinal direction of link 50 to allow relative movement of the rivet pins 20 in holes 58 when the chain is turned about a large radius in the chain run.

Figure 10:
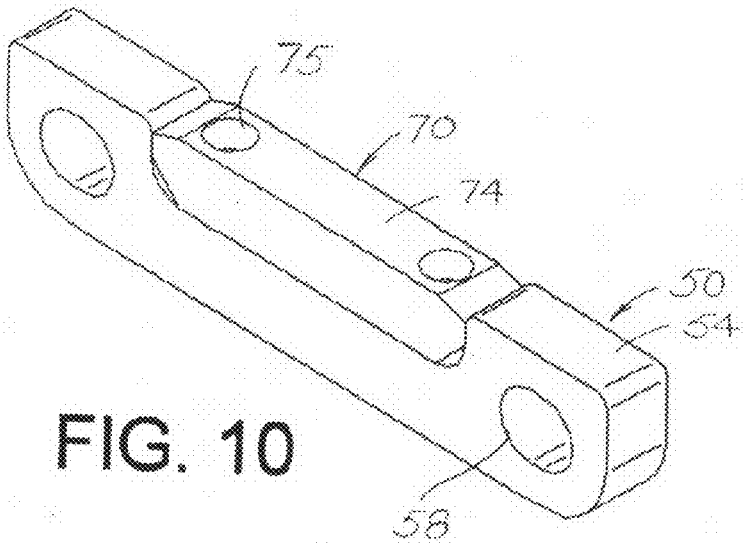
FIG. 10 is a perspective view of the new drive dog chain link with the new filler bar attached as shown in FIG. 5.
Figure 11:
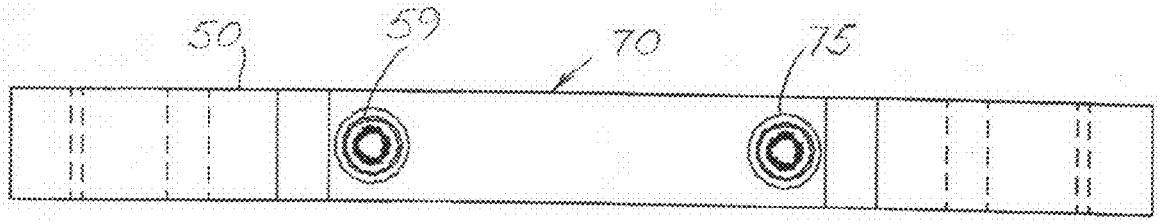
FIG. 11 is a top plan view of the new drive dog chain link with the new filler bar attached as shown in FIGS. 5 and 10.
Figure 12:
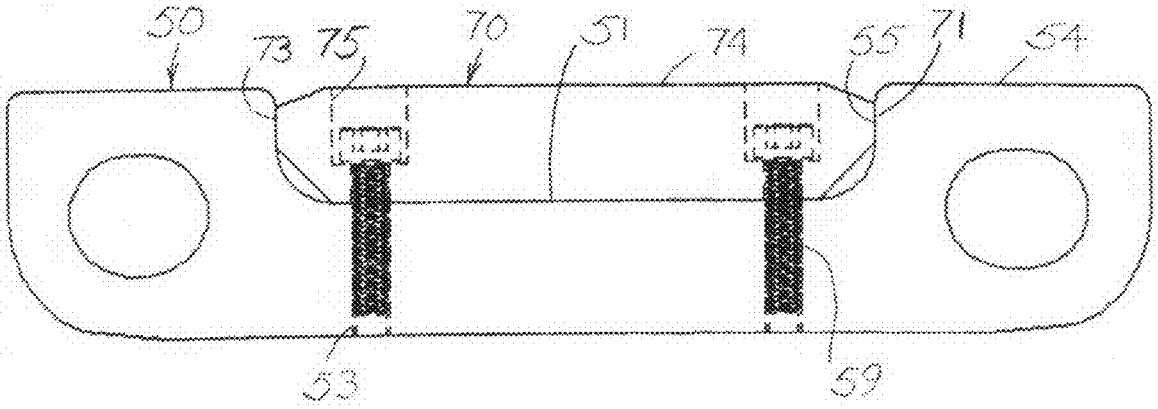
FIG. 12 is a side elevation of the new drive dog chain link with the new filler bar attached as shown in FIGS. 5, 10 and 11.

FIGS. 10-12 show views of the assembled universal inside block link 50 and the filler 70. Machine screws 59 are placed in both recessed holes 75 in the filler bars 70. Ends 71, 73 of the filler bars 70 are flat in the middle, and sloped at the tops and bottoms to ensure tight fitting in ends 55 of the lowered central portion 51 of the universal inside block 50 when the machine screws 59 are tight. Upper surfaces 74 of the fillers are level with the upper surfaces 54 of the universal inside block links 50.

The new invention provides reduced inventories and faster deliveries of drive dog chain for moving carts.

While the invention has been described with reference to specific embodiments, modifications and variations of the invention may be constructed without departing from the scope of the invention, which is defined in the following claims.

We claim:

1. Cart drive dog chain apparatus comprising universal inside attachment links having relatively thick portions and relatively thin portions, filler attachments for connecting to the thin portions of some of the universal inside attachment links, and pusher attachments for connecting to the thin portions of other of the universal inside attachment links, wherein the universal inside attachment links comprise generally rectangular blocks having center sections of reduced height between two end sections, wherein the filler attachments comprise a generally rectangular blocks for fitting in the central sections of the universal inside attachment links and connecting therein with upper surfaces of the filler attachments level with upper surfaces of the end sections of the universal inside attachment links, wherein the central sections have spaced bored and tapped holes and the filler attachments have complementary bored and counterbored holes aligned with the tapped holes in the central sections and further comprising machine screws inserted through the counterbored holes in the filler attachments and threaded in the tapped holes in the central sections of the universal inside attachment links and holding the filler attachments in the central sections.

2. The apparatus of claim 1, further comprising outside sidebar links connected to ends of the universal inside attachment links and thereby providing a chain of a required length.

3. The apparatus of claim 2, wherein the chain is premanufactured with alternating ones of the universal inside attachment links and the connected outside sidebar links and is stored and inventoried in strands of chain to be connected and modified by securing the filler attachments and the pusher attachments to appropriate ones of the universal inside attachment links.

4. The apparatus of claim 2, wherein the chain is premanufactured with alternating ones of the connected universal inside attachment links and outside sidebar links and is stored and inventoried in strands of chain with the fillers connected to the universal inside attachment links for modifying the chain according to orders by removing the filler attachments from selected ones of the universal inside attachment links and replacing the removed filler attachments with the pusher attachments and securing the pusher attachments to the selected ones of the universal inside attachment links.

5. The method of constructing the drive dog pusher chain apparatus of claim 2, comprising alternately connecting the outside sidebars to the universal inside attachment links having the central sections of reduced height in the universal inside attachment link and selectively connecting the filler attachments or the pusher attachments to the central sections.

6. The method of claim 5, further comprising inventorying an assembled chain with the filler attachments connected and secured to the central sections, removing the filler attachments from selected ones of the central sections and replacing the removed filler attachments with the pusher attachments and connecting and securing the pusher attachments at ends of the central sections.

7. The method of claim 6, wherein the connecting and securing comprises sliding machine screws through vertical counterbored holes in the filler attachments and pusher attachments and threading the machine screws into bored and tapped holes in the central sections.

8. The method of claim 6, wherein the connecting and securing comprises riveting, welding or screwing the filler attachments or the pusher attachments in the central sections of the universal inside attachment links.

9. The method of claim 5, further comprising separately inventorying an assembled chain, the filler attachments, and the pusher attachments, and upon receiving an order connecting and securing the pusher attachments to selected ones of the central sections and connecting and securing the filler attachments to other ones of the central sections.

10. The apparatus of claim 1, further comprising the pusher attachments connected in first ends of the central sections, the pusher attachments having sloped upper surfaces extending above upper surfaces of the end sections of the universal inside attachment links.

11. The apparatus of claim 10, wherein the pusher attachments further comprises lugs extending laterally oppositely beyond opposite sides of the universal inside attachment links.

12. The apparatus of claim 11, wherein the lugs have lower extensions extending downward along opposite sides of the central sections for laterally stabilizing the pusher attachments on the central sections of the universal inside attachment links.

13. The apparatus of claim 11, wherein the lugs are positioned in a rearward direction for laterally stabilizing the pusher attachments on the central sections of the universal inside attachment links.

14. Cart drive dog chain apparatus comprising universal inside attachment links having relatively thick portions and relatively thin portions, filler attachments for connecting to the thin portions of some of the universal inside attachment links, and pusher attachments for connecting to the thin portions of other of the universal inside attachment links, wherein the universal inside attachment links comprise generally rectangular blocks having center sections of reduced height between two end sections, wherein the filler attachments comprise a generally rectangular blocks for fitting in the central sections of the universal inside attachment links and connecting therein with upper surfaces of the filler attachments level with upper surfaces of the end sections of the universal inside attachment links, wherein the pusher attachments comprise cubic blocks connected in first ends of the central sections, the pusher attachments having sloped upper surfaces extending above upper surfaces of the end sections of the universal inside attachment links, wherein the pusher attachments further comprises lugs extending laterally oppositely beyond opposite sides of the universal inside attachment links, wherein upper surfaces of the lugs are level with upper surfaces of the end sections of the universal inside attachment links.

15. Cart drive dog chain apparatus comprising universal inside attachment links having relatively thick portions and relatively thin portions, filler attachments for connecting to the thin portions of some of the universal inside attachment links, and pusher attachments for connecting to the thin portions of other of the universal inside attachment links, wherein the universal inside attachment links comprise generally rectangular blocks having center sections of reduced height between two end sections, wherein the filler attachments comprise a generally rectangular blocks for fitting in the central sections of the universal inside attachment links and connecting therein with upper surfaces of the filler attachments level with upper surfaces of the end sections of the universal inside attachment links, wherein the pusher attachments comprise cubic blocks connected in first ends of the central sections, the pusher attachments having sloped upper surfaces extending above upper surfaces of the end sections of the universal inside attachment links, wherein the pusher attachments further comprises lugs extending laterally oppositely beyond opposite sides of the universal inside attachment links, further comprising threaded and tapped holes in the central sections of the universal inside attachment links, and wherein the pusher attachments have bored and counterbored holes complementary to one of the bored and tapped holes in the central sections and further comprising machine screws extending through the bored holes in the pusher attachments and threaded into the one of the bored and tapped holes in the selected central sections of the universal inside attachment links for fixing the pusher attachment in the selected central sections against one end of the selected central sections of the universal inside attachment links.

* * * * *